US006311778B1

(12) United States Patent
Carisella et al.

(10) Patent No.: US 6,311,778 B1
(45) Date of Patent: Nov. 6, 2001

(54) ASSEMBLY AND SUBTERRANEAN WELL TOOL AND METHOD OF USE

(75) Inventors: James V. Carisella; Robert B. Cook; Glenn M. Walls, all of New Orleans, LA (US)

(73) Assignee: Carisella & Cook Ventures, Santa Rosa, FL (US)

( * ) Notice: Subject to any disclaimer, the term of this patent is extended or adjusted under 35 U.S.C. 154(b) by 0 days.

(21) Appl. No.: 09/551,326

(22) Filed: Apr. 18, 2000

(51) Int. Cl.[7] ..... E21B 33/129
(52) U.S. Cl. ..... 166/382; 166/214
(58) Field of Search ..... 166/206, 214, 166/382, 381, 212, 334.1

(56) References Cited

U.S. PATENT DOCUMENTS 2,490,350 * 12/1949 Grable ..... 166/214
3,706,342 * 12/1972 Woolley ..... 166/134
3,872,925 * 3/1975 Owen et al. ..... 166/286
4,184,546 * 1/1980 Nicolas et al. ..... 166/206
4,554,973 * 11/1985 Shonrock et al. ..... 166/192
4,616,703 * 10/1986 Laurent et al. ..... 166/214 X
5,010,958 * 4/1991 Meek et al. ..... 166/382
5,979,550 * 11/1999 Tessier ..... 166/212
6,089,323 * 7/2000 Newman et al. ..... 166/381

* cited by examiner

*Primary Examiner*—Frank Tsay
(74) *Attorney, Agent, or Firm*—Beirne, Maynard & Parsons LLP

(57) ABSTRACT

A subterranean well tool which is manipulatable by a control mandrel between run-in and set positions within a wellbore having casing includes an assembly which provides a selectively operable lock to prevent premature activation of the assembly from the run-in position towards the set position until a predeterminable compressive load is carried through the well tool by the control mandrel to manipulate the assembly from a first initial position to an intermediate position and thereafter to a final extended position.

30 Claims, 6 Drawing Sheets

Fig. 6E
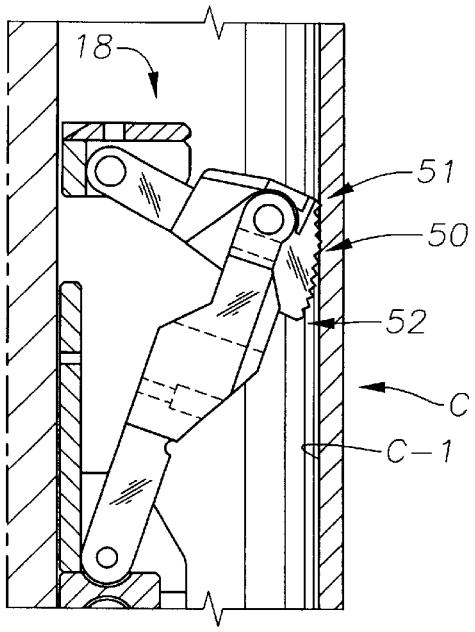
Fig. 6F
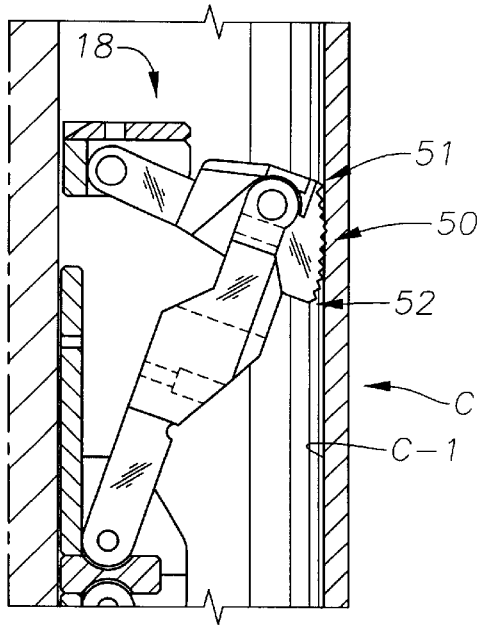
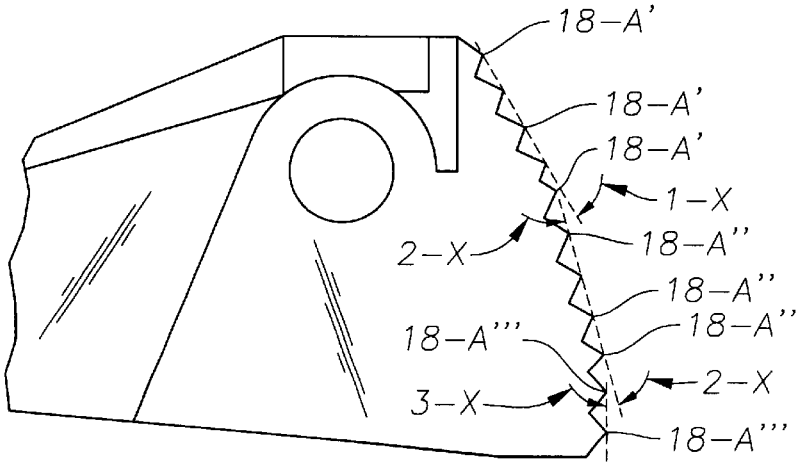
Fig. 7

ASSEMBLY AND SUBTERRANEAN WELL TOOL AND METHOD OF USE

BACKGROUND OF THE INVENTION (1) Field of the Invention

The present invention pertains to an apparatus and method for anchoring a subterranean well tool within a wellbore having casing.

(2) Description of the Prior Art

Subterranean well tools, such as packers, bridge plugs, tubing and other hangers, safety valves, fishing tools, and the like, typically are run into a well subsequent to casing being set and cemented into place. It is desirable to set such tools in the well along the casing against movements in at least one direction, such as against movements toward the top or bottom of the well, rotational movements, or any combination of such movements. Therefore, most such tools are provided with an anchoring assembly. The anchoring assembly is moved from a run-in position when the tool is being run in the well through the casing to the desired depth or location at which it is predetermined to be set and anchored in position. The anchoring means typically expands radially outwardly from the tool such that the anchor can grasp the outer wall of the casing, such as by teeth or otherwise, to prevent any such movements thereafter. Of course, it is extremely important that any such anchoring assembly included with any such subterranean well tool not be manipulatable between the run-in position to the set position, or there between, at any time that the well tool is being run into the well, or actuated in the well, prior to the time that it is determined to be anchored within the well, either for permanent setting of the well tool or temporary setting and withdrawal after a particular operation within the well has been effected. Any such premature actuation of the anchoring assembly could result in a failure of the tool to thereafter properly set at the desired location at the desired time, and, in dramatic instances, could result in the well tool, or other tool, becoming stuck in the well, necessitating a time consuming and otherwise expensive fishing operation to retrieve the well tool.

The present invention addresses the deficiencies in prior art devices, as generally described above.

SUMMARY OF THE INVENTION

The present invention provides an assembly such as in an anchoring assembly, and method of use, in which the assembly is combined with a subterranean well tool manipulatable by a control mandrel between a run-in and set position within a wellbore having casing. The subterranean well tool may be a packer, bridge plug, safety valve, tubing or other hanger, cementing tool, or any other tool typically known and utilized by those skilled in the art of subterranean well tools. The control mandrel may be directly connected to tubing, such as a drill string, workover string, or the like, extending to the top of the well, which may be rotated, or activated by push/pull technique. Alternatively, the mandrel may be operated by a setting or other tool activated pneumactically, hydraulically, electrically, or mechanically.

The assembly may have at least one housing member, and, preferably, may have upper, central and lower housing members. These housing members may be vertically aligned with respect to one another. The control mandrel extends through at least one of the housing members and may extend through all of such members by means of a bore which is defined through the housing members. Support means, such as a series of outwardly pivotal supporting finger or supporting elements are shiftably movable between initial and intermediate positions wherein the support elements or finger elements are in a retracted condition relative to the housing member, or all housing members, if more than one housing member is provided. The support members or finger elements may be moved to a final, extended position when the well tool is in the set position. The support member or finger elements may be radially disposed around the exterior of a housing member, such as the central housing member, if a plurality of housing members are provided, as described below.

Each of the support members a finger elements have first and second ends, with the first end of the support member, or finger elements, preferably, being joined relative to a housing member to permit outward pivotal movements between the intermediate position and the final, extended position. Means, such as one or more platforms, are pivotally secured to the second end of the support member and moveable by the support member from a position of substantial vertical radial alignment with a central housing to a horizontal alignment position with a housing member or members. Anchoring elements are provided on the platform for anchoring the combination to the casing in the set position against movements in at least one direction, or, preferably, any direction. The anchoring elements may include a series of radially extending wicker teeth which are etched or otherwise machined or profiled an outboard area of one or more of the platforms.

The assembly of the present combination has particular utility when the well tool includes components which are activatable by and require a compressive force therethrough for effective setting against the smooth inner wall of the well casing. For example, the mechanism has particular utility when combined with a subterranean well tool including an expandible, compressible elastomeric packer element and means for preventing extrusion of the packer element. For example, the present invention has particular utility when incorporated into the well tool of co-pending U.S. patent applicable entitled "High Expansion Elastomeric Plug", filed on May 11, 1999, and assigned U.S. Ser. No. 09/309,699, and, especially, in an embodiment generally illustrated FIGS. 13 and 14 of said application.

In the method of the present invention, the combination well tool and assembly is secured to a control mandrel, which may, in turn, be operatively associated with an actuating tool such as that disclosed in co-pending U.S. Patent Application entitled "Electrically Actuated Setting Tool", U.S. Ser. No. 09/309,698, filed May 11, 1999. Thereafter, the combination is lowered into the well to a position in which it is desired that the combination be anchored against the well casing. A first compressive load is transmitted through the combination by means of the mandrel to initiate activation of the well tool, such as by applying a compressive force to a well packer component, thence to an anti-extrusion component. As continued compressive force is applied through the mandrel, such as by applying a pulling force through the mandrel, the well packer component is set without the support member, or preferred finger elements, of the anchor assembly, being moved from the initial position. Thereafter, an increased compressive load is applied through the mandrel whereby the supporting member, or finger elements, are moved to an intermediate position, but the support element still is in a retracted condition relative to the housing member and the casing. In the intermediate position, the support element, or finger elements if utilized, are "unlocked" and are activated for subsequent movement from the intermediate position to the final extended position. The final extended position of the supporting element is effected by continued upward pull of the mandrel, again applying even more compressive force through the combination, causing the supporting member to pivot or flex outwardly to, in turn, permit anchoring elements to grasp the inner wall of the casing such that the combination is anchored against movement in at least one direction.

DESCRIPTION OF THE DRAWINGS

FIGS. 6A–6F together constitute a series of enlarged cross-sectional illustrations of a portion of the platform assembly illustrated in FIG. 3 and particularizing the configuration of the angled, or semi-circular, teeth elements providing a universal anchoring mechanism for anchoring the apparatus in any one of a number of varying internal diameter casings or other conduits.

FIG. 7 is an enlarged cross-sectional view of the teeth arrangement of a universal anchoring mechanism showing the angled teeth in an alternate preferred form in multiple plains.

DESCRIPTION OF THE PREFERRED EMBODIMENTS

Figure 1A:
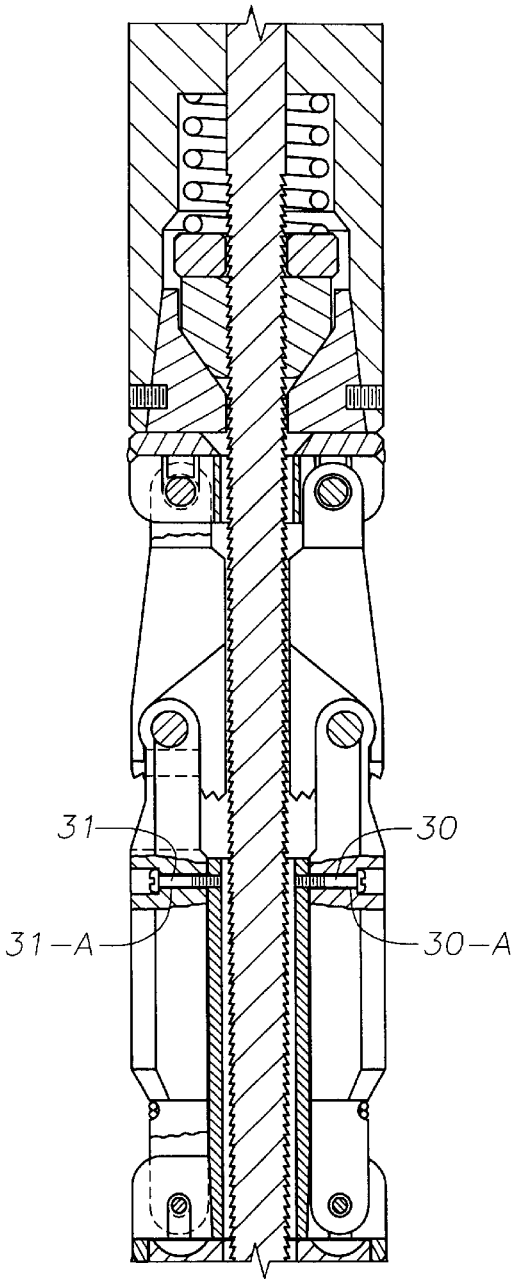
FIGS. 1A and 1B together constitute a longitudinal partial cross-sectional view of the anchor assembly in combination with a subterranean well tool, such as a packer and an extrusion resistor, all illustrated in the "run-in" position.
Figure 1B:
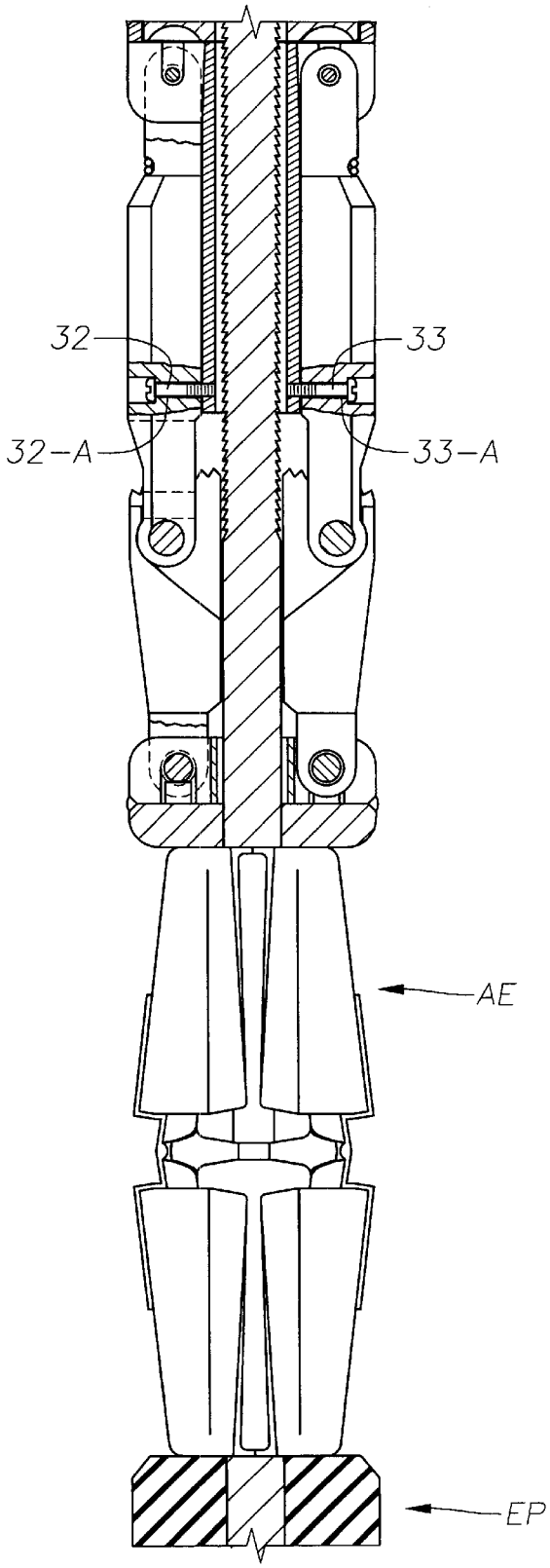
Figure 2A:
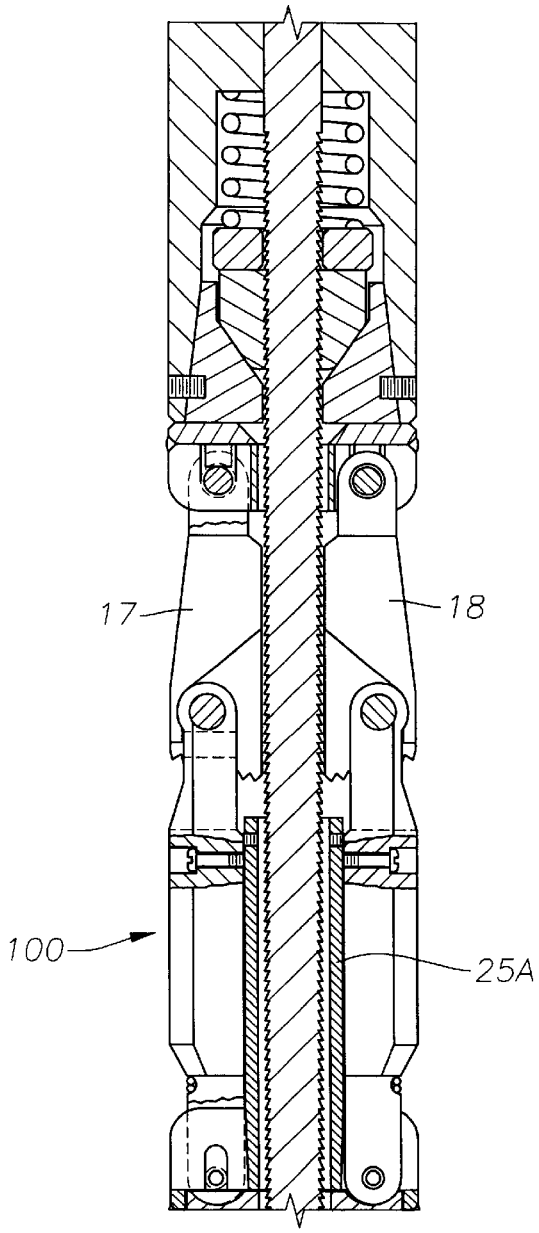
FIGS. 2A and 2B are views similar to that of FIGS. 1A and 1B, illustrating the combination with the anchor assembly in the intermediate position.
Figure 2B:
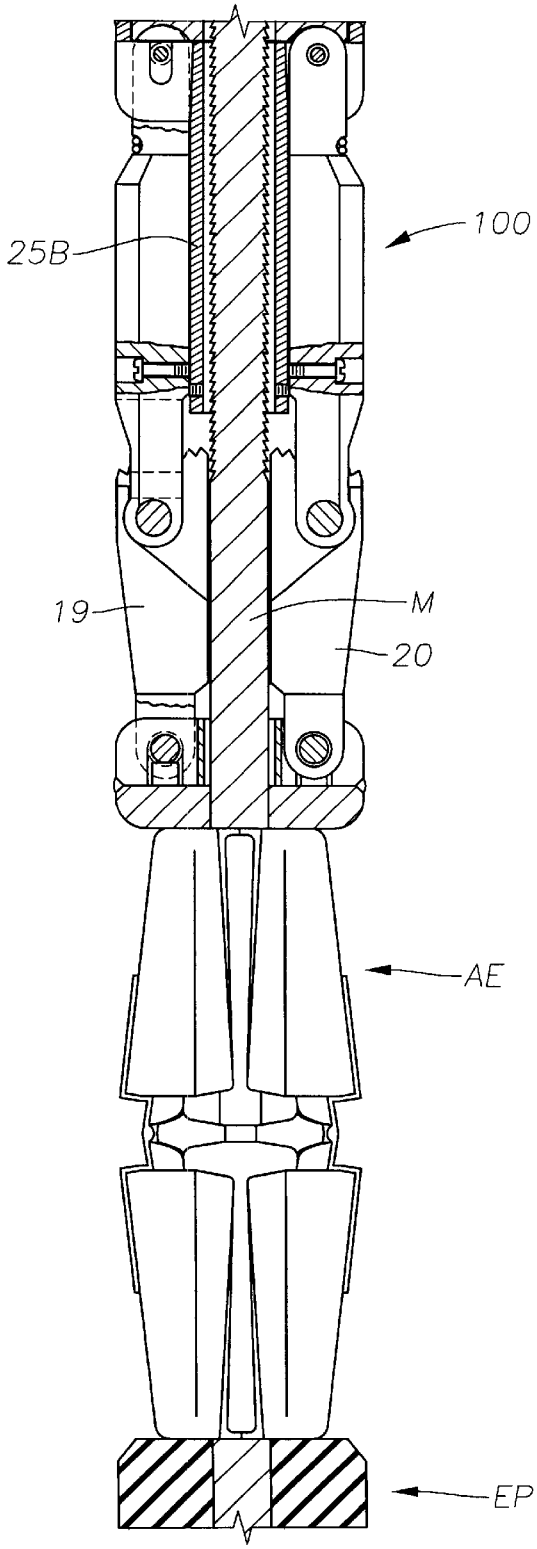
Figure 3:
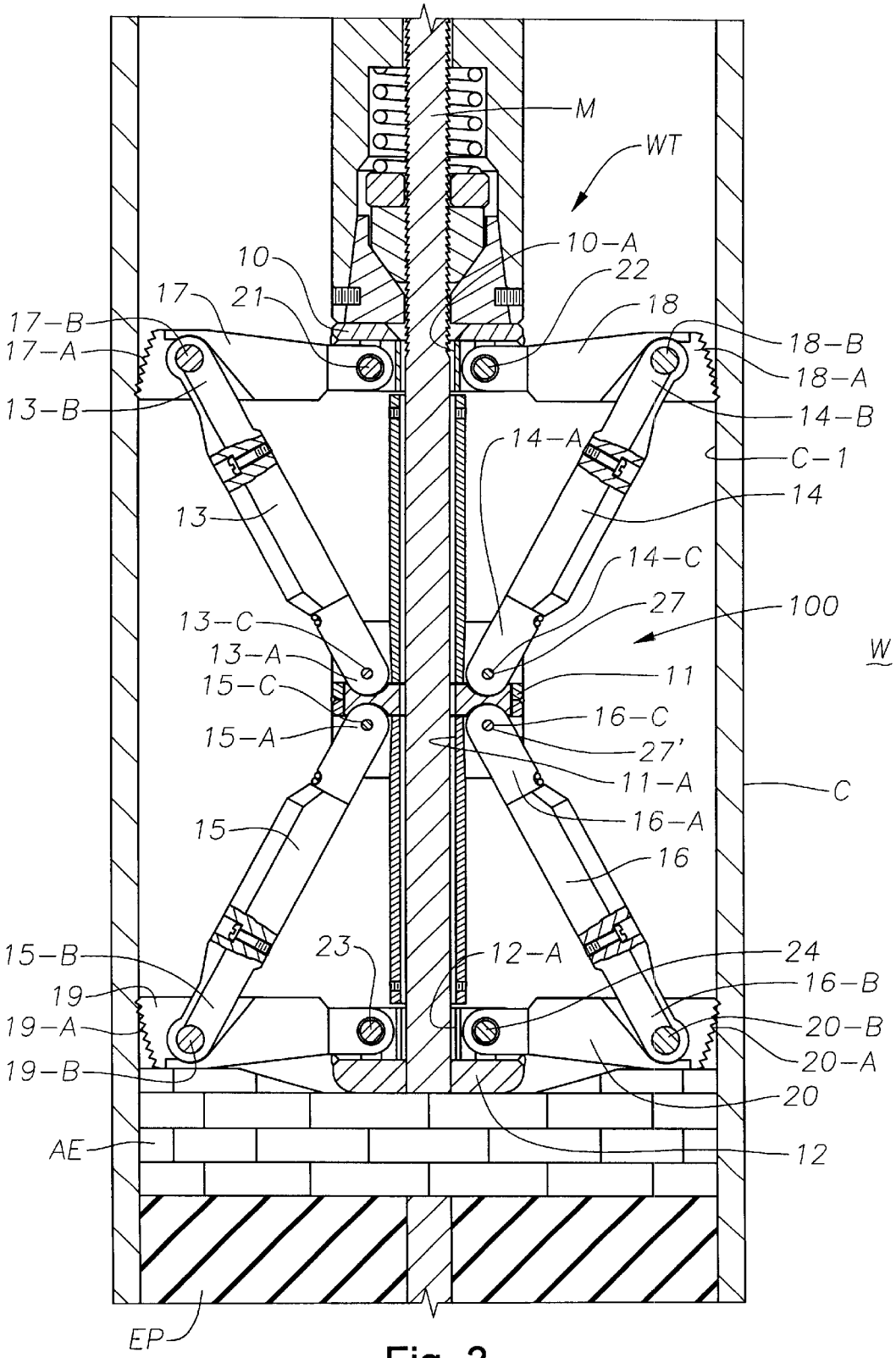
FIG. 3 is an enlarged cross-sectional view of the combination in the final, or set position.

Now with respect to the drawings, the present invention provides an anchor assembly 100 which includes an upper housing 10, a central housing 11 there below and a lower housing member 12. Each of the housing members 10, 11 and 12 have a central bore 10-A, 11-A and 12-A for receipt there through of a control mandrel M. A series of elongated finger elements 13, 14, 15 and 16 are secured to the central housing 11 at first ends 13-A, 14-A, 15-A and 16-A. A groove 13-C, 14-C, 15-C and 16-C is provided through each of the ends 13-A, 13-B, 13-C and 13-D for receipt of a circumferentially extending ring element 27 through the upper finger members 13 and 14, and a similarly constructed ring element 27' in the lower set of fingers 15 and 16.

Each of the fingers 13, 14, 15 and 16 have a second end 13-B, 14-B, 15-B and 16-B which are respectively secured to platform member 17, 18, 19 and 20 by means of pivot pins 17-B, 18-B, 19-B and 20-B. In turn, the platform 17 is secured to the upper housing 10 by means of a retaining metal pin 22 disposed through a groove 21. Likewise, the platform 18 also is operatively secured relative to the upper housing 10 by means of a similar retaining pin 22 received in the platform 18 through a groove or bore 21. Similarly, the lower platforms 19 and 20 each are secured to the lower housing 12 by means of a retaining pin 24 retained within a groove 23 through each of the platforms 19 and 20.

Each of the platforms 17, 18, 19 and 20 have a series of teeth 17-A, 18-A, 19-A and 20-A profiled, such as machining, or the like, around and on the outboard-most end of the respective platform 17, 18, 19 and 20, for grasping engagements with the smooth inner wall C-1 of the casing C within the well W, when the anchor assembly 100 is shifted to the set, or final, position.

The well tool WT of the present invention comprises the anchor assembly 100, an elastomeric packer EP of known construction, and an anti-extrusion mechanism AE. The elastomeric packer EP and/or the anti-extrusion mechanism AE may be one of a number of designs well know to those skilled in the art and, preferably, may be of the design illustrated in co-pending U.S. application Ser. No. 09/309,699, filed May 11, 1999 and entitled "High Expansion Elastomeric Plug."

Figure 5:
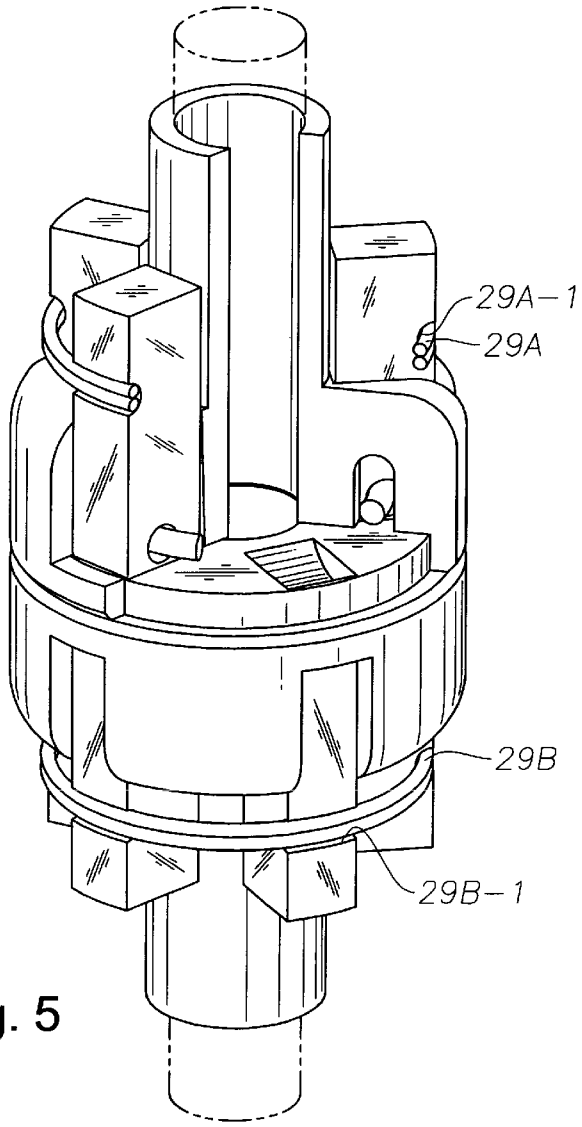
FIG. 5 is a perspective view similar to that of FIG. 4, illustrating the anchor assembly components in the intermediate position.
Figure 4:
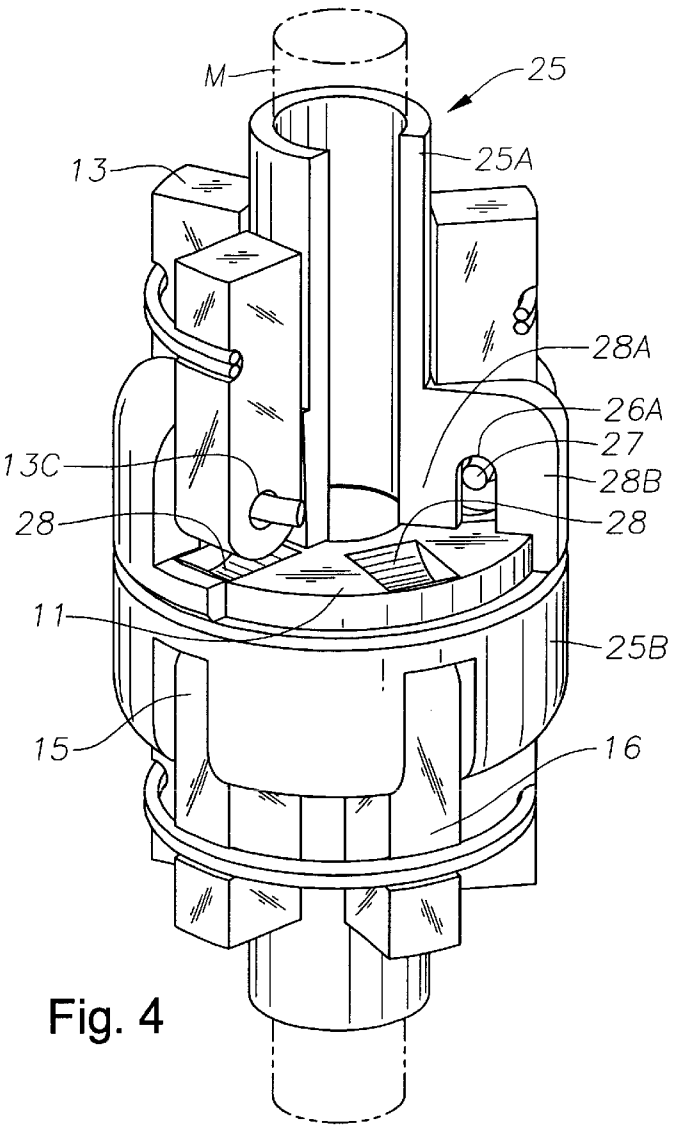
FIG. 4 is a perspective view of the preferred sleeve mechanism and central housing of the anchor assembly of the present invention in the "run-in" position.

Now, as particularly shown in FIGS. 4 and 5, the anchoring mechanism 100 further includes a sleeve 25 consisting of upper and lower cylindrical sleeve members 25-A and 25-B, around the exterior of the mandrel M. The upper sleeve member 25-A includes first and second H-leg elements 28-A and 28-B bridging each of the fingers. The H-leg elements 28-A and 28-B have defined there between a slotted grooveway 26 with and open lower end 26-A. A metallic ring 27 passes through a groove, such as groove 13-C in finger 13, and in all of the fingers, to secure the fingers together and within the cylindrical sleeve member 25-A. A similar metallic ring 27' passes through grooves, such as 15-c and 16-c in each of the fingers 15 and 16.

The central housing 11 has a series of circumferentially extending receiving profiles 28 for receipt of the fingers, such as 13 and 14 when the anchor assembly 100 is shifted to intermediate and set positions.

Each of the upper finger elements, such as 13 and 14, have defined around their exterior a groove way 29-A-1 for housing of a backup wire retainer 29-A therein. Likewise, the lower fingers, such as 15, and 16 also have a groove way 29-B-1 for receipt of another backup wire retainer 29-B. Each of the wire retainers 29-A and 29-B serve to further assure inadvertent premature shifting of the fingers, 13, 14, 15 and 16 from the run-in, or initial, position, toward the set position prior to the time that it is desired to actually anchor the well tool WT. The backup wire retainers 29-A and 29-B will shear, or otherwise break, or part, to permit expansion of the fingers 13, 14, 15 and 16 as the fingers are urged pivotally outwardly from the intermediate position to the set position.

Each of the sleeve members 25-A and 25-B are secured to the respective fingers by means of a shear pin 30, 31, 32 or 33 received in a opening 33-A, 32-A, 31-A and 30-A, respectively. As the mandrel M is shifted, for example, upwardly, relative to the well tool WT, a compressive load is defined through the well tool WT and the shear pins 31, 31, 32 and 33 shear, separating the upper and lower sleeve members 25-A and 25-B from initial engagement with the respective finger elements to permit the fingers to move from the initial position to the intermediate position. As the anchor 100 is moved to the intermediate position, the upper fingers 13 and 14 will move downwardly such that their lower most end will be snugly engaged within the receiving profiles 28 of the central housing 11. Likewise, the lower fingers 15 and 16 will have their upper most ends shifted into companion receiving profiles in the lower sleeve member 25-B on the opposite face of the central housing 11.

Now with specific reference to FIGS. 6A–6F there is illustrated the platform 18 with a series of semicircularly configured teeth elements thereon for grasping into the inner wall C-1 of a casing C. The configuration, as shown, for the teeth elements provides for universal ability for a device of only one size to be set within one of a number of internal diameter sized casing or other tubular strings within the well W. The platform 18 is shown with a grasping teeth configuration 18-A having a series of peaks 18-A" and valleys 18A" spaced there between. Such teeth 18-A may be machined onto the platform 18 in any one of a number of ways known to those skilled in the art. The outermost edge of the peaks 18-A' forming the teeth 18-A define a radial line 50 which has a first external point of curvature 51 at one end, i.e., the uppermost end, and a second external point of curvature 52 at the other end, which will be somewhat outwardly extending from the first external point of curvature 51. The second external point of curvature is larger than the first external point of curvature and the radial line 50 has an external point of curvature continuous from the first end 51 to the second end 52.

Figure 6A:
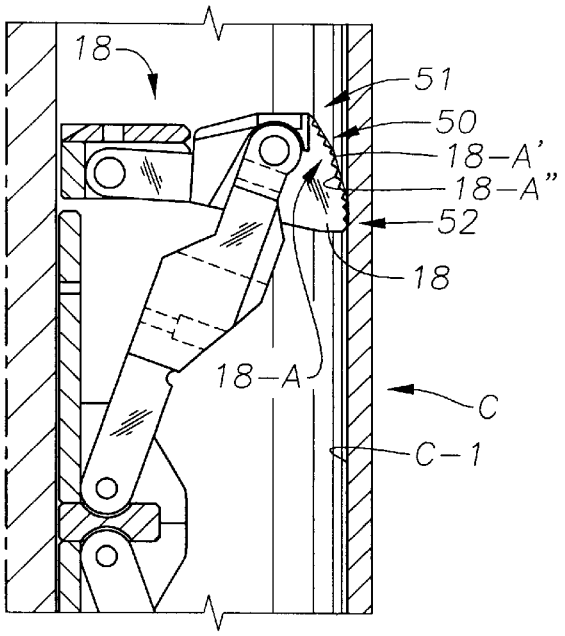

As shown in FIG. 6A, when some of the peaks 18-A' of the teeth configuration 18-A adjacent the second external area 52 contact the inner wall C-1 of the casing C, continued movement of the platform 18 is resisted and the actuation energy defined through the mandrel M to the apparatus 100 is transferred through the teeth 18-A into the inner wall C-1 as the teeth 18A begin to grasp and engage such inner wall. Peaks 18A' defined on the platform 18 along the radial line 50 which are not of a companion external diameter do not contact or grasp the inner wall C-1, but satisfactory anchoring engagements are provided by means of the peaks 18-A1 that do come into contact with and are driven into the inner wall C1 of the casing C.

Figure 6B:
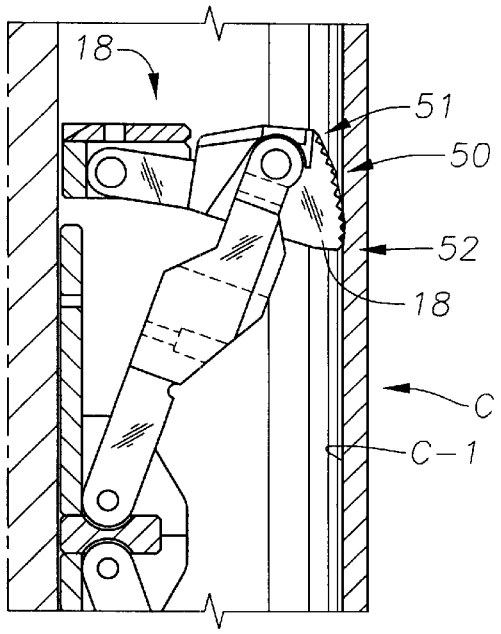
Figure 6C:
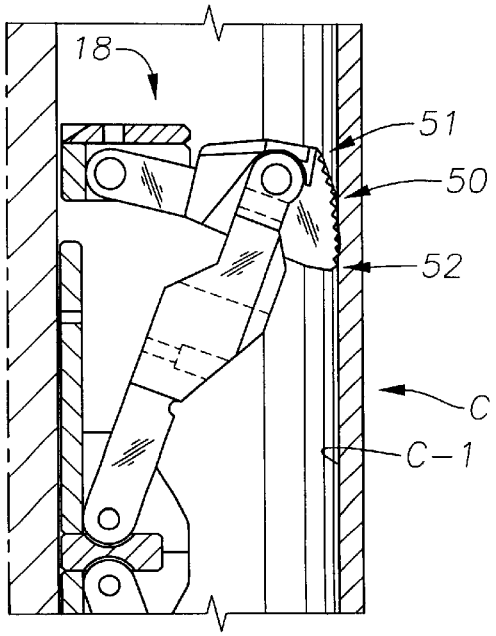

Likewise, FIG. 6B illustrates additional movement of the platform 18 from the position shown in FIG. 6A when the inner wall C1 of the casing C has a smaller internal diameter than the casing C shown in FIG. 6A. As shown in FIG. 6B, more of the peaks 18-A' are driven into the inner wall C1 of the casing C due to the size differentiation from that of the casing C shown in FIG. 6A. Likewise, as shown in FIG. 6C, a more central portion of the peaks 18-A' are driven into the inner wall C1 in instances in which the apparatus 100 is desired to be set within sized casing smaller than that shown in FIG. 6B. In this instance, it will be noted that some of the peaks 18-A' adjacent the enlarged end 52 along the radial line 50 of the platform 18 may not come into partial or complete grasping contact with the inner wall C1 of that sized casing C because of the semi-circular radial configuration of the teeth 18A along the line 50.

Figure 6D:
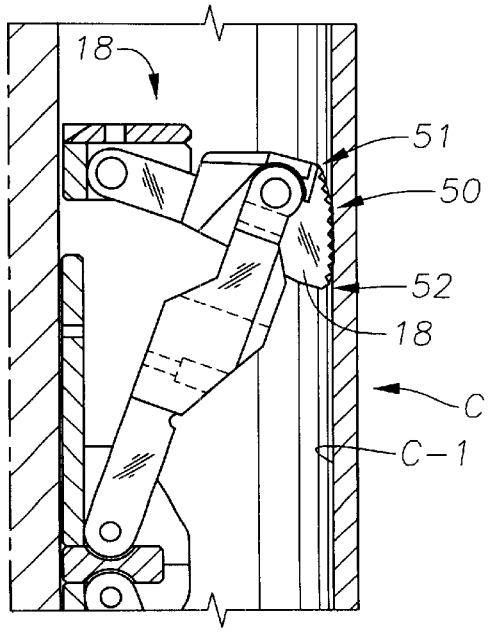

FIG. 6D shows the anchoring engagement of the apparatus 100 along the more central portions of the peaks 18-A1 of the teeth 18A in casing smaller than as shown in FIG. 6C. Again, because of the configuration of the radial line 50 between the ends 51 and 52, forming a semi-circular configuration, the peaks 18-A' at the upper most end of the teeth configuration and those at the lowermost end of the teeth configuration will not come into anchoring engagement with the inner wall C1 of the casing C.

FIG. 6E shows the positioning of the apparatus 100 and the teeth 18-A in even smaller sized internal diameter casing C. Here, many of the peaks 18-A' below the approximate middle point between the first and second ends 51 and 52 may not come into contacting engagement with the inner wall C1 of the casing C, yet there is sufficient grasping engagement between the teeth 18A and the innerwall C1 for satisfactory anchoring purposes.

Finally, FIG. 6F shows the positioning of the platform 18 relative to the teeth 18A in the smallest sized casing such that the peaks 18-A' along the uppermost internal curving end 51 of the platform 18 provide the grasping engagement of the inner wall C1 of the casing C, with most of the teeth there below not being in grasping engagement.

Now with reference to FIG. 7 an alternate preferred embodiment of the construction and design of the teeth configuration as shown in FIGS. 6A–6F is illustrated. The teeth are in a plurality of plains, such as plain 1, plain 2 and plain 3. A line, plain 1, may be defined for the first plain from the first peak point 18-A' through the last peak point 18-A'. Plain 2 is defined by a line 2-X which is angularly offset a predetermined amount from the line 1-X of plain 1 between the first, or upper, and last, or lowermost, peaks 18A' on the line 1-X. Plain 2 is defined as the line 2-X between the first peak 18-A" and the last peak 18-A" along the line 2-X. Yet a third plain, plain 3, is defined along the line 3-X which is angularly offset an amount from the line 2-X defining plain 2. Plain 3 contains a series of teeth peaks marked 18-A'". Thus, setting in the largest internal diameter casing will be effected by the teeth configuration and grasping effect of the teeth along plain 3, while the next largest internal diameter casing will engage the teeth along plain 2, and so on. When utilizing this configuration for the teeth, a number of plains may be provided for the contemplated universal sizes of internal diameter casing for the particular application at hand.

OPERATION

The combination is made up at the top of the well and will include the well tool WT and the anchor assembly 100. The mandrel M is inserted through each of the bores 10-A, 11-A and 12-A of the respective upper, central and lower housing members 10, 11 and 12, and through the anti-extrusion mechanism AE, as well as the elastomeric packer EP. The well tool WT now is run in the well to a predeterminable location within the casing C.

When it is desired to set the well tool WT, a first compressive force is transferred through the mandrel by means of a setting tool (not shown) to first cause anchoring of the well tool WT through activation, then sealing of the packer EP. Upward pull on the mandrel M through the setting tool causes each of the shear pins 30, 31, 32 and 33 to shear, separating the fingers 13, 14, 15 and 16 from the sleeve, or bridge, 25. Continued, and yet additional, compressive force which is transferred through the mandrel M such as by continued upward pull, now causes the upper fingers 13 and 14 to be received within the receiving profiles 28 of the central housing 11. The receiving profiles may be either individually contoured for each of the sets of finger, or may be of unitized, circular construction, providing a continuous profile or receiving area 28 for the sets of fingers. Likewise, and concurrently, the upper most ends of the fingers 15 and 16 are received within a similarly profiled receiving profile 28 within the lower sleeve member 25-B. In this manner, the sleeve members 25-A and 25-B contract, vertically, relative to the central housing 11, such that the "gap" defined by the receiving profiles 28, is eliminated. The anchor assembly 100 now is moved from the initial, or run-in position, as shown in FIG. 4, to the intermediate position, as shown in FIG. 5.

Thereafter, continued, additional, compressive load may be carried through the well tool W by additional pulling through the mandrel M and the setting tool to cause the backup wire retainers 29-A and 29-B to break due to additional expansive urging forces thereon by outward radial movements of the fingers 13, 14, 15 and 16 being transferred into the fingers by means of the joinder of the ends of the fingers within the receiving profile 27 of the central housing 11. Subsequent to the breaking of the wire retainers 29-A and 29-B, the fingers 13, 14, 15 and 16 continue outward of movements toward the inner wall C-1 of the casing C until the platforms 17, 18, 19 and 20 are shifted radially outwardly towards the casing C and become vertically disposed relative to the mandrel M. In this position, the platforms 17, 18, 19 and 20 should be at substantially a 45° angle relative to the sleeve 25 and the mandrel M. When the platforms are in the relative vertical position, as described, the teeth 17-A, 18-A, 19-A and 20-A will be caused to be imbedded within the inner wall C-1 of the casing C to resist movements of the well tool W in at least one direction, and, as illustrated, in a plurality of directions, i.e., upwardly and downwardly.

As the compressive load is transferred through the well assembly 100, by the mandrel M, the anti-extrusion component AE of the packer EP will be urged outwardly to prevent the elastomeric packer EP from extruding when the well tool WT is set along the smooth inner wall C-1 of the casing C. Final compressive movements of the mandrel M cause the packer EP to become set within the well.

As described, the anchor assembly 100 of the present invention is designed to eliminate premature or inadvertent activation until the well tool WT is desired to be anchored at such time and at such location within the well W. In this manner, shock, and other forces which may be encountered during the running of the tool WT into and through the well W are not operatively transferred to the anchor assembly 100, and/or bypassed by provision of the sleeve 25 and the "gap" or link, defined as the distance between the lower or first ends of the respective finger elements and the depth of the receiving profiles 27 within the central housing 11.

The assembly 100 preferably may be used in a tool anchor device, as particularly described but may also be used in many other devices in which premature activation must be avoided, the invention providing an assembly which bridges activation forces as well as shock across a component, until needed.

Although the invention has been described in terms of specified embodiments which are set forth in detail, it should be understood that this is by illustration only that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In combination with a subterranean well tool including anchoring means, said well tool being manipulatable by a control mandrel between run-in and set positions within a wellbore having casing, an anchor assembly comprising:

(a) at least one housing member;

(b) a bore defined through said at least one housing member for receipt of said control mandrel;

(c) pivoting means moveable between initial and intermediate positions wherein said pivoting means are in a retracted condition relative to said at least one housing member and a final extended position when said well tool is in said set position;

(d) means for permitting outward pivoting movement of said pivoting means from said intermediate position to said final extended position; and (e) sleeve means including first and second members for containment of said at least one housing member and further defining a grooveway for travel therein of said pivoting means between initial and intermediate positions.

2. The combination of claim 1 further comprising sleeve means including first and second members containing said central housing and further defining first and second grooveways for travel therein for each of said first ends of said finger elements between said initial and intermediate positions.

3. The anchor assembly of claim 1: said pivoting means including a series of angularly configured teeth elements for gasping into the inner wall of the casing, said teeth elements including a profile of peaks and valleys, said peaks terminating across an outer radial line of curvature extending substantially from one end of said teeth elements to another end of said teeth elements, said line of curvature having a first external curvature point at one end thereof and a second external curvature point at another end thereof, said line of curvature being continuous from said one point to the other point.

4. The anchor assembly of claim 1: said pivoting means including a series of teeth elements for grasping into the inner wall of the casing, said teeth elements including a profile of peaks and valleys, said peaks terminating across a plurality of plains extending from and across two or more of said peaks, said plains being angularly offset from one another.

5. In combination with the subterranean well tool manipulatable by a control mandrel between run-in and set positions within a wellbore having casing, an anchor assembly, comprising:

(a) a plurality of housing members;

(b) outwardly pivotal support members shiftably moveable between initial and intermediate positions wherein said support members are in a retracted condition relative to at least one of said housing members, and final extended position when said well tool is in said set position, said support members being positioned around one of said housing members and having one end joined relative to one of said housing members to permit outward movements of said supporting members between said intermediate position and said final extended position;

(c) platform means pivotally secured to another end of the support members and moveable by said support members from a position of substantial vertical radial alignment with one of said housing members to horizontal alignment relative to said mandrel; and (d) anchoring means on said platform means for anchoring said combination to said casing in said set position against movements in at least one direction.

6. The combination of claim 5 further comprising means for selectively transmitting a compressive load through said mandrel to said combination without movements of said supporting members from initial to intermediate positions.

7. The combination of claim 6 wherein the compressing load is transmitted through said support members and one of said housing members only when said support members are not in the initial position.

8. The combination of claim 5 further comprising means for selectively transmitting a compressive load through said mandrel to said combination without movements of said support members from initial to intermediate positions and comprising a bridge selectively engaged to said support members and disengagably moveable relative to said support members upon application of a predeterminable compressing load on said combination through said mandrel to shift said support members to each of intermediate and final extended positions.

9. The combination of claim 5 wherein one of said housing members includes a receiving profile for accepting one end of said support members when said support members are shifted to intermediate and final extended positions.

10. The anchor assembly of claim 5 wherein said anchoring means comprises a series of angularly configured teeth elements for gasping into the inner wall of the casing, said teeth elements including a profile of peaks and valleys, said peaks terminating across an outer radial line of curvature extending substantially from one end of said teeth elements to another end of said teeth elements, said line of curvature having a first external curvature point at one end thereof and a second external curvature point at another end thereof, said line of curvature being continuous from said one point to the other point.

11. The anchor assembly of claim 5 wherein said anchoring means comprises a series of teeth elements for grasping into the inner wall of the casing, said teeth elements including a profile of peaks and valleys in a plurality of plains angularly offset from one another.

12. In combination with a subterranean well tool manipulatable by a control mandrel between run-in and set positions within a wellbore having casing, an anchor assembly comprising:

(a) upper, central and lower housing members;

(b) a bore defined through each of said housing members for receipt of said control mandrel;

(c) a series of outwardly pivotable supporting finger elements shiftably movable between said initial and intermediate positions wherein said finger elements are in a retracted condition relative to said housings and a final extended position when said well tool is in said set position, said finger elements being radially disposed around the exterior of said central housing member, each of said finger elements having first and second ends, said first end of each finger element being joined relative to said central housing member to permit outboard pivotal movements of said finger elements between said intermediate positions and said final extended position;

(d) platform means pivotally secured to the second end of the finger elements and movable by said finger elements from a position of substantial vertical radial alignment with said central housing member to horizontal alignment with said upper and lower housing members; and (e) anchoring elements on said platform means for anchoring said combination to said casing in said set position against movements in at least one direction.

13. The combination of claim 12 further comprising means for selectively transmitting a compressing load through said mandrel to said combination without movements of said finger elements from initial to intermediate positions.

14. The combination of claim 13: said central housing including a receiving profile for accepting the first ends of said finger elements when said finger elements are shifted to intermediate and final extended positions.

15. The combination of 13 wherein the compressing load is transmitted through said finger elements and said central housing only when said finger elements are not in the initial position.

16. The combination of claim 12 further comprising bridge means for selectively transmitting a compressing load through said mandrel to said combination without movements of said finger elements from initial to intermediate positions and comprising a bridge selectively engaged to each of said finger elements and disengagingly moveable relative to said finger elements on application of a predeterminable compressing load on said combination through said mandrel to shift said finger elements to each of intermediate and final extended position.

17. The combination of claim 16, wherein said means for selectively transmitting said compressing load further comprises shearable means between said finger elements and said bridge means.

18. The anchor assembly of claim 12 wherein said anchoring elements include a series of angularly configured teeth elements for gasping into the inner wall of the casing, said teeth elements including a profile of peaks and valleys, said peaks terminating across an outer radial line of curvature extending substantially from one end of said teeth elements to another end of said teeth elements, said line of curvature having a first external curvature point at one end thereof and a second external curvature point at another end thereof, said line of curvature being continuous from said one point to the other point.

19. The anchor assembly of claim 12 wherein said anchoring means comprises a series of teeth elements for grasping into the inner wall of the casing, said teeth elements including a profile of peaks and valleys in a plurality of plains angularly offset from one another.

20. A method of anchoring a subterranean well tool manipulatable by a control mandrel between run-in and set positions within a wellbore having casing, said well tool including an anchor assembly, said method comprising steps of:

(1) introducing into said wellbore an apparatus comprising:

(a) upper, central and lower housing members;

(b) a bore defined through each of said housing members for receipt of said control mandrel;

(c) a series of outwardly pivotable supporting finger elements shiftably movable between said initial and intermediate positions wherein said finger elements are in a retracted condition relative to said housings and a final extended position when said well tool is in said set position, said finger elements being radially disposed around the exterior of said central housing member, each of said finger elements having first and second ends, said first end of each finger element being joined relative to said central housing member to permit outboard pivotal movements of said finger elements between said intermediate positions and said final extended position;

(d) platform means pivotally secured to the second end of the finger elements and movable by said finger elements from a position of substantial vertical radial alignment with said central housing member to horizontal alignment with said upper and lower housing members;

(e) anchoring elements on said platform means for anchoring said combination to said casing in said set position against movements in at least one direction;

(2) manipulating the mandrel to apply a first compressive load through said well tool;

(3) increasing the compressive load through the well tool via the mandrel to shiftably move said finger elements from initial position to intermediate position; and (4) continuing to increase the compressive load through the well tool via the mandrel to shift the finger elements from the intermediate position to the set position, whereby said platform means are pivoted from a position of substantial vertical radial alignment with said central housing member to substantial horizontal alignment with said upper and lower housing members, and further whereby said anchoring elements are anchored to said casing against movements in at least one direction.

21. A method of anchoring a subterranean well tool manipulatable by a control mandrel between run-in and set positions within a well bore having casing, said well tool including an anchor assembly, said method comprising the steps of:

(1) introducing into said well bore, an apparatus comprising:

(a) at least one housing member;

(b) a bore defined through said at least one housing member for receipt of said control mandrel;

(c) pivoting means moveable between initial and intermediate positions wherein said pivoting means are in a retracted condition relative to said at least one housing member and a final extended position when said well tool is in said set position;

(d) means for permitting outward pivoting movement of said pivoting means from said intermediate position to said final extended position;

(e) sleeve means including first and second members for containment of said at least one housing member and further defining a grooveway for travel therein of said pivoting member between initial and intermediate positions;

(2) manipulating the mandrel to apply a first compressive load through said well tool;

(3) increasing the compressive load through the well tool via the mandrel to shiftably move said pivoting means from initial position to intermediate position; and (4) continuing to increase the compressive load through the well tool via the mandrel to shift the pivoting means from the intermediate position to the set position.

22. In combination with a subterranean well tool, said well tool being manipulatable by a control mandrel between run-in and set positions within a wellbore having casing, an assembly comprising:

(a) at least one housing member;

(b) a bore defined through said at least one housing member for receipt of said control mandrel;

(c) pivoting means moveable between initial and intermediate positions wherein said pivoting means are in a retracted condition relative to said at least one housing member and a final extended position when said well tool is in said set position;

(d) means for permitting outward pivoting movement of said pivoting means from said intermediate position to said final extended position; and (e) sleeve means including first and second members for containment of said at least one housing member and further defining a grooveway for travel therein of said pivoting means between initial and intermediate positions.

23. In combination with a subterranean well tool manipulatable by a control mandrel between run-in and set positions within a wellbore having casing, an assembly; comprising:

(a) a plurality of housing members;

(b) outwardly pivotal support members shiftably moveable between initial and intermediate positions wherein said support members are in a retracted condition relative to at least one of said housing members, and final extended position when said well tool is in said set position, said support members being positioned around one of said housing members and having one end joined relative to one of said housing members to permit outward movements of said supporting members between said intermediate position and said final extended position; and (c) platform means pivotally secured to another end of the support members and moveable by said support members from a position of substantial vertical radial alignment with one of said housing members to horizontal alignment relative to said mandrel.

24. The combination of claim 23 further comprising means for selectively transmitting a compressive load through said mandrel to said combination without movements of said supporting members from initial to intermediate positions.

25. The combination of claim 24 wherein the compressing load is transmitted through said support members and one of said housing members only when said support members are not in the initial position.

26. The combination of claim 23 further comprising means for selectively transmitting a compressive load through said mandrel to said combination without movements of said support members from initial to intermediate positions and comprising a bridge selectively engaged to said support members and disengagably moveable relative to said support members upon application of a predeterminable compressing load on said combination through said mandrel to shift said support members to each of intermediate and final extended positions.

27. The combination of claim 23 wherein one of said housing members includes a receiving profile for accepting one end of said support members when said support members are shifted to intermediate and final extended positions.

28. An anchoring assembly for use in a subterranean well comprising:

(a) a platform pivotally actuatable from a retracted position to an expanded position, said platform including a series of angularly configured teeth elements for grasping into the inner wall of the casing, said teeth elements including a profile of peaks and valleys, said peaks terminating across an outer radial line of curvature extending substantially from one end of said teeth elements to another end of said teeth elements, said line of curvature having a first external curvature point at one end thereof and a second external curvature point at another end thereof, said line of curvature being continuous from said one point to the other point.

29. The apparatus of 28 wherein said platform is pivoted by means of a series of finger elements having one end secured to said platform.

30. An anchor assembly for use in a subterranean well, comprising:

(a) a platform pivotally actuatable from a retracted position to an expanded position, said platform including a series of configured teeth elements for grasping into the inner wall of the casing, said teeth elements including a profile of peaks and valleys disposed along a plurality of plains extending on said platform, said plains being angularly offset from one another.

* * * * *